US005383308A

United States Patent [19]

Beloff et al.

[11] Patent Number: 5,383,308

[45] Date of Patent: Jan. 24, 1995

[54] SANDING BLOCK

[76] Inventors: Marvin Beloff, 133 Eaton Ave., Meriden, Conn. 06451; Statis J. Pappas, 718 Old Colony Rd., Meriden, Conn. 06450

[21] Appl. No.: 223,048

[22] Filed: Apr. 5, 1994

[51] Int. Cl.[6] ..... B24D 15/02

[52] U.S. Cl. ..... 451/519; 451/515; 451/513; 451/523

[58] Field of Search ..... 51/387, 383, 382, 381, 51/385, 386, 391, 372, 358, 148

[56] References Cited

U.S. PATENT DOCUMENTS

| | | | |
|---|---|---|---|
| 2,270,835 | 1/1942 | Hibert | 51/391 |
| 2,400,928 | 5/1946 | Hein | 51/387 |
| 2,457,466 | 12/1948 | Hanna | 51/387 |
| 2,761,257 | 9/1956 | Mendelsohn | 51/372 |
| 3,106,806 | 10/1963 | Hutchins | 51/387 |
| 4,730,430 | 3/1988 | Petrovich | 51/387 |
| 5,172,524 | 12/1992 | Poss | 51/382 |

FOREIGN PATENT DOCUMENTS

| | | | |
|---|---|---|---|
| 2617522 | 11/1977 | Germany | 51/387 |

*Primary Examiner*—Robert A. Rose

[57] ABSTRACT

A hand sanding block is formed with two blocks, which may be of equal or unequal lengths of like cross section and disposed in coplanar relationship with opposed inner ends. The blocks are freely movable towards and away from each other almost to the point of separation, by means of a pair of spaced dowel pins projecting from one block for telescopic engagement in corresponding spring loaded sockets in the other block and are normally held apart in spaced relationship by the springs in the sockets. For mounting and removing an endless sanding belt the blocks are pressed together so the inner ends are in abutting relationship and once the belt is in place, the holding pressure is released so the blocks can move apart to provide tension on the belt. The block with the socket has two precisely placed holes for screws to be inserted near the forward end of the internal springs holding the spring ends in their sockets while at the same time the dowel pins, are securely glued in the opposite block, therefore preventing the total separation of the blocks at any time.

2 Claims, 2 Drawing Sheets

SANDING BLOCK

BACKGROUND OF INVENTION

This invention relates to improvements in sanding block of the type adaptable for use with continuous loop sanding belts used with electric belt sanders.

More particularly, this invention relates to the type of sanding block that includes a pair of like cross sections which may be of equal or unequal lengths, disposed in coplanar relationship and normally held in spaced relationship by a relatively strong spring means to provide tension on an attached endless belt. Such types of sanding blocks are well known as exemplified in U.S. Pat. Nos. 2,400,928, 2,761,257, 3,106,806, and 5,172,524.

This type of sanding block usually includes one or more dowel pins on one component that are slidably and removably journalled in corresponding spring locked sockets of the other component and with this type of block, the two components are manually pressed or wedged together, while at the same time handling the belt for mounting or removal. While this is basically a simple task, since the two components are freely movable relative to each other only to a point which will exert the appropriate amount of pressure on the endless belt which surrounds it. Any loss of the manual grip on the pressed together components before the belt is adequately in place will result in the components moving away from each other under the force of the springs. Depending on the strength of the springs being used, and to prevent one of the components from being propelled in a projectile like fashion to cause injury or damage in addition to the inconvenience and nuisance involved, one approach to this problem is to glue the one end of the one or more dowel pins to one of the component parts, attach the springs tightly to the other end of the one or more dowel pins, insert the dowel pins with springs tightly attached into a pre drilled hole or holes in the other component.

Once the one or more dowel pins, secure with springs attached, are inserted into the properly aligned hole or holes one or more appropriate screw or screws are screwed into the upper flat plane of the sanding block so that it or they connect properly with the inserted spring internally located in one of the components and hold the spring or springs and two components together so that they are inseparable. This present invention represents a different novel and simple but effective means for accomplishing the same purpose and solution to the problem.

It has been observed in the use of a two component sanding block as characterized, that if the belt should accidentally come off due to wear, tearing, or otherwise, the two components will also move apart as described. This is a serious disadvantage with this type of block and, accordingly, another object of this invention is to provide a means to keep the two components of such a sanding block from complete separation with or without the belt.

Considerable trial and error in the construction of this sanding block has resulted in a workable shape which offers four different sanding surfaces and the ability to sand flat planes as well as to poke into narrow or unflat aspects of the piece being worked on.

Appropriate grooves have been fashioned along the sides of one component for secure finger grip. The spring mechanism is constructed to both hold the belt securely in place for hard sanding and also permit the user ease in forwarding or reversing the belt while in use in order to permit movement away from a used surface to a new and unused surface of the belts 360% circumference.

The foregoing objects and such further objects as may appear herein, or be hereinafter pointed out, together with the advantages of this invention will be more fully discussed and developed in the more detailed description of the accompanying drawings.

SUMMARY OF THE INVENTION

In accordance with this invention, a hand sanding block is formed with two blocks which may be of equal or unequal length, of like cross section and disposed in coplanar relationship with opposed inner ends. The blocks are freely movable towards and away from each other, but not to the point of total separation, by a pair of spaced dowel pins with springs attached, projecting from one component block, for telescopic engagement in the other component block and are normally held apart in spaced relationship by the screw secured springs in the sockets. For mounting and removing an endless sanding belt, the blocks are held pressed together so that the inner ends are in abutting relationship and once the belt is in place, the holding pressure is released so the blocks can move apart to provide tension on the belt. The block with the sockets where the springs are secured in place by screws has finger hold grooves on the sides, and is shaped at the front tip for more complex sanding.

DESCRIPTION OF THE PREFERRED EMBODIMENTS

Figure 3:
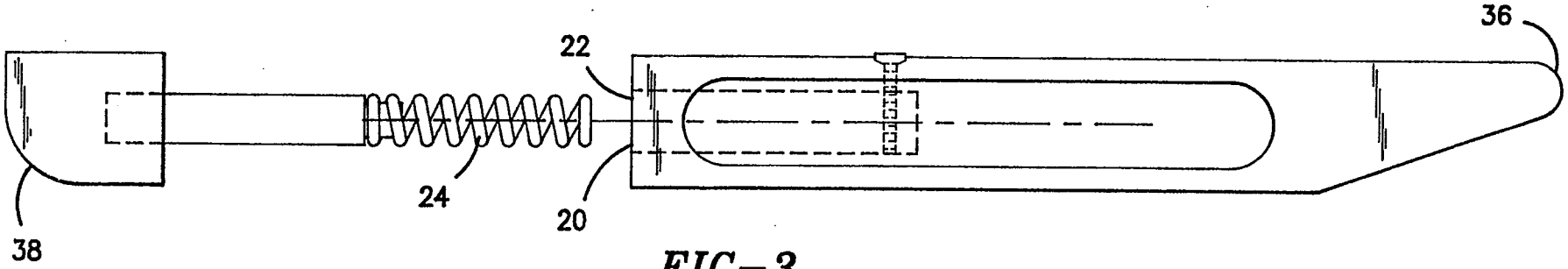
FIG. 3 is a cross sectional exploded view of the sanding block of FIG. 1 depicting the relative position of the component parts.
Figure 4:
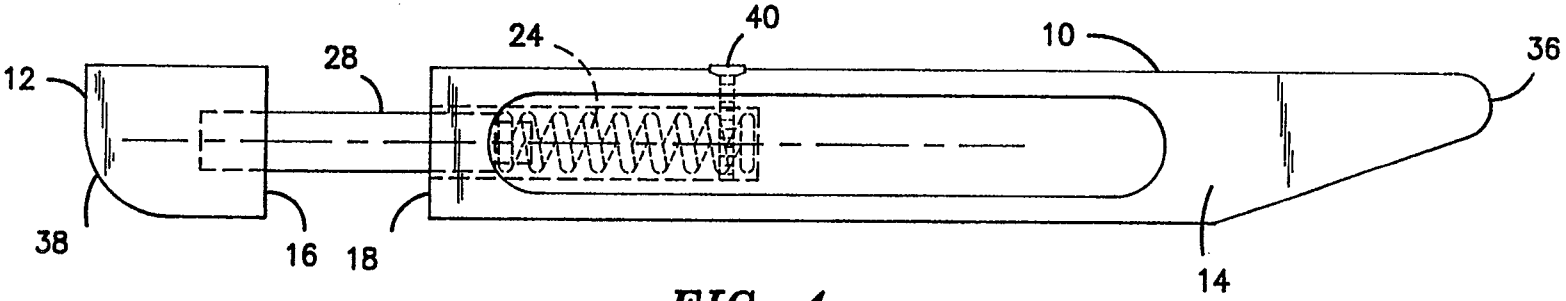
FIG. 4 is a cross sectional fully assembled view of a sanding block in an extended position prior to mounting the sanding belt.
Figure 1:
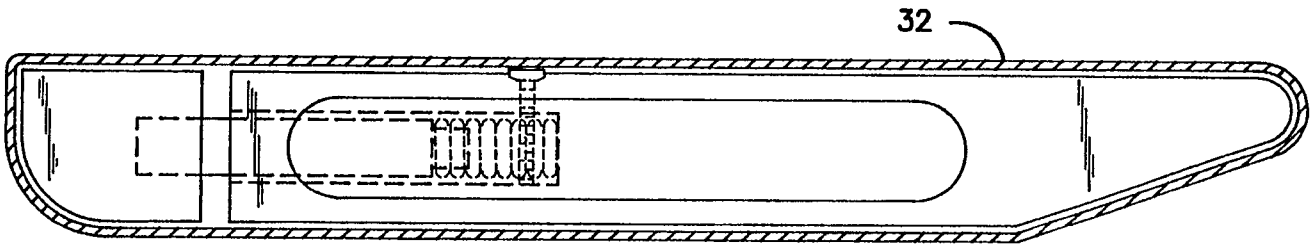
FIG. 1 is a cross sectional view of a sanding block in wedged together position and fitted into a sanding belt in a ready to work with mode.

As shown in the drawings, the sanding block according to the invention is designated generally by the numeral 10 and includes two blocks 12, 14 of like cross sections and disposed in coplanar alignment to define the opposed inner ends 16, 18. Blocks 12, 14 are shown unequal in length but they may be of like dimensions for purpose of the present invention. Block 14 is provided with a pair of spaced axial sockets 20, 22 communicating with the inner end 18 and in which sockets are the respective coil springs 24, 26. Block 12, is provided with a pair of dowel pins 28, 30 projecting from inner end 16 and disposed for telescopic engagement in the respective sockets 20, 22 against springs 24, 26 so that there is free relative movement between blocks 12, 14 towards each other to abutting relationship as shown in FIG. 1 and away from other as shown in FIG. 4. Springs 24, 26 normally urge blocks 12, 14 in spaced apart relationship to provide tension on a mounted sanding belt 32 as best seen in FIGS. 1 and *2b*.

The outer end of block 14 is contoured as at 36 providing a narrow workable shape for detailed sanding to poke into areas that are not flat and need to be poked into. The outer end of block 12 is contoured as in 38 in a 90% round in order to use yet another surface when and where needed.

A sanding block constructed substantially in the same form as that so far described has long been known where blocks 12, 14 are pressed into abutting relationship against the pressure of springs 24, 26 and must be held in that position to reduce the overall length of the two blocks to permit the encircling of the same by an endless belt 32 and after which, the pressure on the blocks is released so the blocks can move apart under the force of springs 24, 26 to provide tension on the belt and keep it in place. The blocks are also pressed together for removing the belt.

Figure 2B:
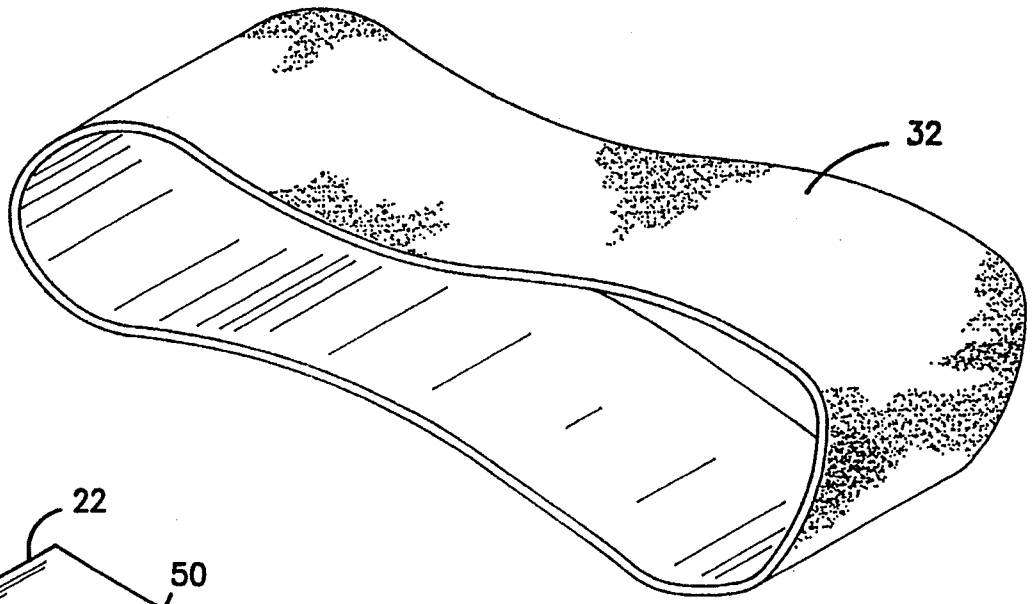
FIG. 2*b* is a top perspective exploded view of an endless sanding belt which is to be mounted on the sanding block of FIG. 1.
Figure 2:
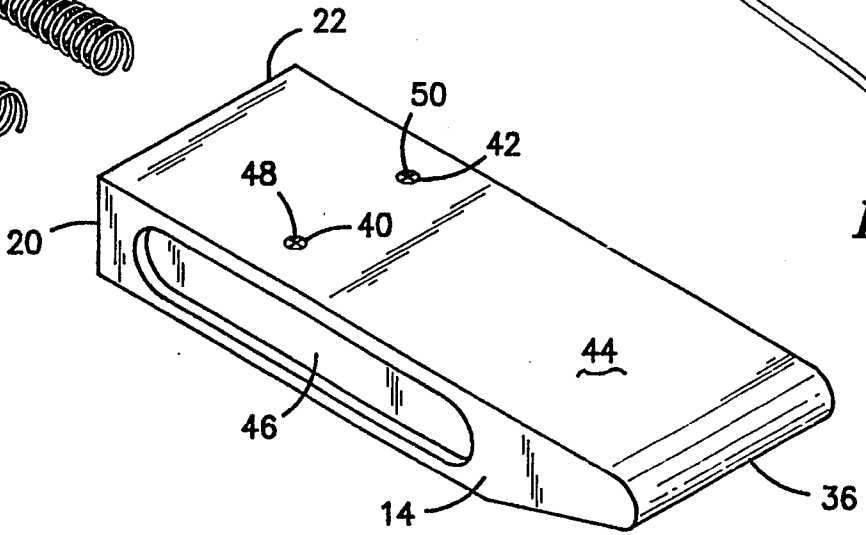
FIG. 2 is a top perspective exploded view of the sanding block of FIG. 1 depicting the relative position of the component parts.
Figure 2:
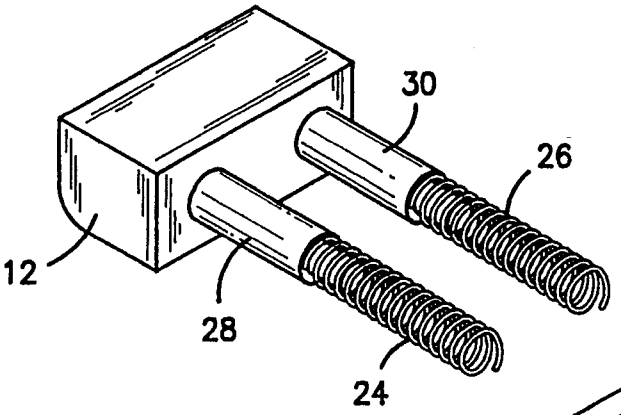

With sanding block arrangements according to the prior art, the blocks are freely movable relative to each other even to the point of complete separation so that any loss of one's grip on the pressed together blocks before the belt is adequately in place and while one is simultaneously trying to handle such belt, will release the tension on the compressed springs causing the blocks to move away from each other and, depending upon the force of the springs, this can be a complete separation of the blocks with one likely to move in a projectile-like fashion that can be a source of injury or damage in addition to the inconvenience and nuisance involved. To overcome these disadvantages, in accordance with the invention, one end of the pair of spaced dowel pins 28, 30 are glued, into sockets similar to those in block 14, and springs 24, 26 are twisted onto a prepared nose carefully carved out of the forward end of dowel pins 28, 30 in such a manner as to tightly retain the springs. Two screw holes 40, 42 are drilled in a position above the forward ends of springs 24, 26 wedged gently in their sockets 20, 22, and screws 48, 50 are inserted so that they fit neatly into the end spiral of the inner springs 24, 26 causing the blocks 12, 14 to become inseparable as shown in FIG. 2.

We claim:

1. A sanding block comprising:

A pair of coplanar aligned blocks having opposed inner ends for selectively carrying an endless belt over one coplanar side of said coplanar blocks, said endless belt being removably attached thereto;

means interiorily of said pair of blocks affording free relative movement of said pair of blocks away from each other to a point of inseparation and toward each other to an abutting position of said inner ends;

spring means in one of said blocks to normally urge said one block into spaced apart relationship; and operable means between said inner ends for limiting movement of said ends away from each other to prevent complete separation of said blocks from each other, said operable means comprising screws placed in registration with said spring means at one of said ends and dowel pins glued to said one block at another of said ends.

2. The sanding block of claim 1 including, in combination, positioned longitudinal finger grooves and contours for providing any one of four sanding surfaces.

* * * * *